US005478078A

United States Patent [19]

Lee

[11] Patent Number: 5,478,078

[45] Date of Patent: Dec. 26, 1995

[54] GOLF PUTTING PRACTICE DEVICE FOR USE ON A GOLF PUTTER

[76] Inventor: Do W. Lee, 1808 Daeyeon-Dong, Daeyeonsamikbeach, Apt. 105–1103, Nam-ku, Pusan, Rep. of Korea

[21] Appl. No.: 354,851

[22] Filed: Dec. 9, 1994

[51] Int. Cl.[6] ..... A63B 69/36

[52] U.S. Cl. ..... 273/186.1; 273/194 A; 273/168

[58] Field of Search ..... 273/186.1, 186.2, 273/163 R, 163 A, 164.1, 193 R, 194 R, 194 A, 194 B, 187.4, 187.6, 168, 173, 174, 175, 16.75

[56] References Cited

U.S. PATENT DOCUMENTS

| | | | |
|---|---|---|---|
| 2,057,821 | 10/1936 | Costello | 273/194 A |
| 3,021,141 | 2/1962 | Polsky et al. | 273/186.2 |
| 3,039,776 | 6/1962 | Faini | 273/186.2 |
| 3,912,277 | 10/1975 | Pelz | 273/186.2 |
| 4,025,078 | 5/1977 | Pelz | 273/186.2 |
| 4,130,282 | 12/1978 | Pelz | 273/186.2 |
| 4,139,198 | 2/1979 | Kanavas | 273/186.2 |
| 4,323,246 | 4/1982 | Nehrbas, Jr. | 273/186.2 |

OTHER PUBLICATIONS

Preceptor Golf Limited, "The Teacher Putting System", Golf World, Dec. 1974, p. 45.

*Primary Examiner*—V. Millin
*Assistant Examiner*—Steven B. Wong
*Attorney, Agent, or Firm*—Birch, Stewart, Kolasch & Birch

[57] ABSTRACT

A golf putting practice device includes a C-shaped body member having a rear surface with a pressure sensitive adhesive backing for removably attaching the guiding device to the striking face of a golf putter and a front surface having a pair of elongated vertical rails disposed on both inside edges of a pair of vertical legs, two pairs of pins disposed near the ends of the rails, and a marker pin disposed on the center of a bridge connected to both legs whereby when properly stroked with the golf putter, the rails and pins allow a golf ball to pass therebetween and strike the sweet spot through an aperture in the C-shaped body member, thereby causing the golf ball to roll straight in the direction of the intended target and when the golf ball is improperly stroked, it strikes the rails or pins and is turned away from the target.

23 Claims, 4 Drawing Sheets

FIG.6(A)
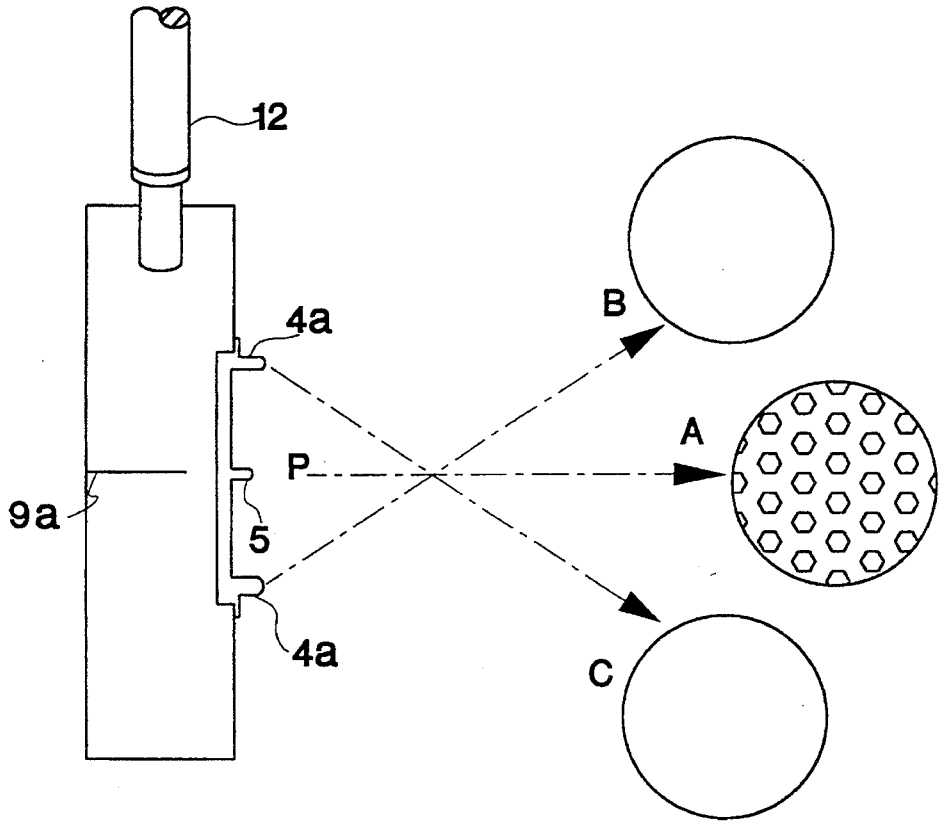
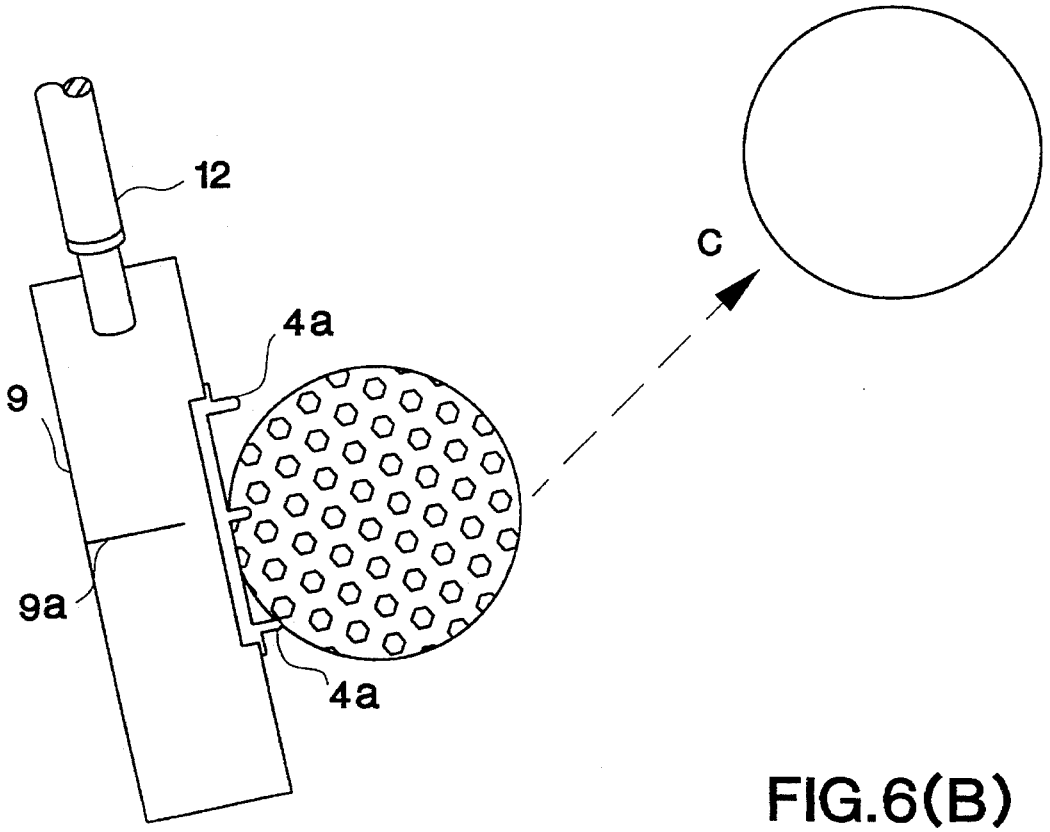
FIG.6(B)

GOLF PUTTING PRACTICE DEVICE FOR USE ON A GOLF PUTTER

BACKGROUND OF THE INVENTION

1. Field of the Invention

The present invention relates to an improved golf putting practice guiding device for use on a golf putter. The golf putting practice device is used to train and practice hitting and putting a golf ball more accurately.

2. Description of Related Art

Various types of golf putting practice devices for training and practicing putting a golf ball are generally known in the art to be utilized with a guide device consisting of a flat rectangular shaped base and a pair of elongated vertically spaced apart and parallel side rails. However, these golf putting practice devices suffer from a number of problems such as, for example, it is difficult for the user to perceive rectilinear movement of the putter and it is difficult for the user to train for hitting a golf ball with the sweet spot of the putter head.

Also, other various types of golf putting aids for attaching to a striking face of the golf putter are known in the art. For example, U.S. Pat. No. 4,323,246 to Nehrbas, Jr. discloses a golf putting plate including a pressure sensitive adhesive backing for removably attaching the golf putting plate to the striking face of a golf putter. The plate includes a pair of upright spaced parallel rails extending outward at 90° from the front surface of a backing member which covers the striking face of the putter head.

However, this golf putting plate suffers from a number of deficiencies and disadvantages such as, for example, it fails to achieve effective results since this golf putting plate covers the striking face of the putter head and the user can get a different feeling when the ball strikes the golf putting plate compared with the ball striking the real striking face of the golf putter. Also, the pair of upright spaced parallel rails extending outward at 90° from the front surface hinder the eyeshot and feeling while the user practices with the golf putter having this golf putting plate.

SUMMARY OF THE INVENTION

Accordingly, it is an object of the present invention to provide an improved golf putting practice device for use on a golf putter for a person to train and practice putting a golf ball more accurately, which eliminates the above problems encountered with conventional golf putting practice devices.

A further object of the present invention is to provide a golf putting practice device which is provided with a rectangular configured opening space having a downward opening. Accordingly, when the user trains and practices by use of the device of the present invention, the golf ball is allowed to be struck with the sweet spot of the real striking face of the golf putter so as to give the user the same feeling as the original golf putter without a golf putting practice device.

Still another object of the present invention is to provide a golf putting practice guiding device which is simple in structure, inexpensive to manufacture, durable in use, and refined in appearance.

The above and other objects of the present invention are achieved by providing a golf putting practice device which includes a C-shaped body member defining a front surface and a rear surface. The front surface of said C-shaped body member having a pair of elongated vertical rails disposed on both inside edges of a pair of vertical portions, two pairs of projections disposed on or near the ends of the pair of rails and a projection disposed on the center of a bridge portion connected to both vertical portions thereof. The rear surface of said C-shaped body member having a pressure sensitive adhesive backing for removably attaching the body member to the striking face and/or the top of the putter head of the golf putter.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a golf putting practice guiding device which includes a C-shaped body member having a rear surface with a pressure sensitive adhesive backing for removably attaching the guiding device to the striking face of a golf putter and a front surface having a pair of vertically elongated rails disposed on both inside edges of a pair of vertically elongated legs, two pairs of pins disposed on or near the ends of the rails, and a marker pin disposed OD the center of a bridge connected to both legs. When the golf putting practice device is applied to a golf putter and when a golf ball is properly stroked with the golf putter, the rails and pins allow a golf ball to pass therebetween and strike the sweet spot through an opening of the C-shaped body member thereby causing the golf ball to roll straight in the direction of the intended target and when the golf ball is improperly stroked, it strikes on the rails and pins and is turned away from the target.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIGS. 6(A) and 6(B) are perspective views of the golf putter of FIG. 4, illustrating the use thereof in putting practice;

DESCRIPTION OF THE PREFERRED EMBODIMENTS

Figure 1:
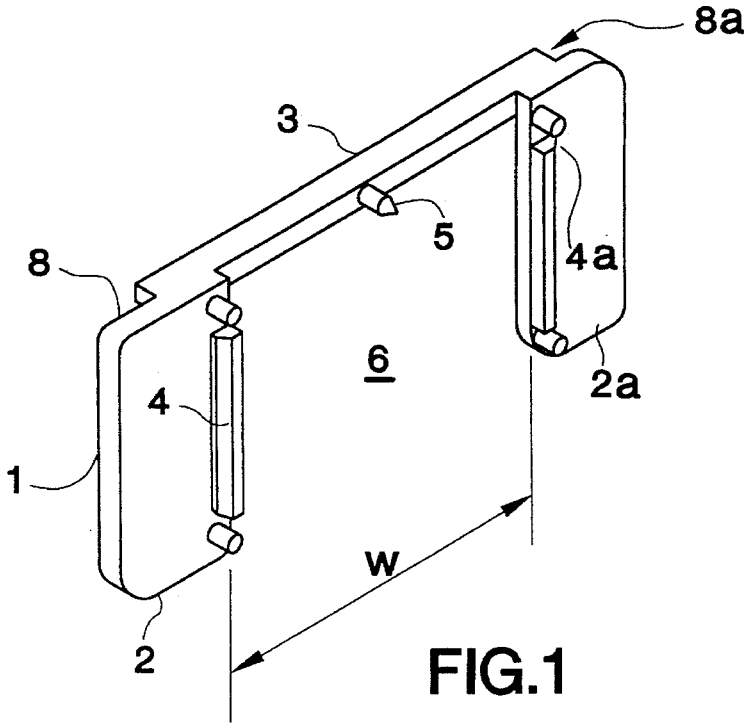
FIG. 1 is a perspective view of a front surface of a golf putting practice guiding device in accordance with the present invention.

Referring now in detail to the drawings for the purpose of illustrating preferred embodiments of the present invention, the improved golf putting practice guiding device for use on a golf putter as shown in FIGS. 1–7 includes a C-shaped body member 1 to be attached to a striking face of a putter head 9 of a golf putter 12.

The C-shaped body member 1 includes vertically elongated left and right portions or legs 2 and 2*a*. A horizontally elongated connecting portion or bridge 3 is connected to each of the legs 2 and 2*a*. The bridge 3 also extends backward at a right angle from both upper portions of the left and right legs 2 and 2*a*. Accordingly, the bridge 3 has a pair of spaces 8*a* disposed at both ends thereof for avoiding a slant putter neck of the golf putter 12 and reducing the weight thereof. The C-shaped body member 1 also includes a front face and a rear face.

The front face of the body member 1 includes a pair of vertically elongated rails 4 disposed on both inside edges of the pair of vertically elongated legs 2 and 2*a*. Two pairs of pins 4*a* are disposed near the ends of the rails 4, and a marker pin 5 is disposed on the center of the bridge 3. The marker pin 5 is designed to be lined up with a marker 9*a* of the putter head.

As shown in FIGS. 3, 5, 6(A), and 6(B), the height of the pair of rails 4, two pairs of pins 4*a* and marker pin 5 are the same as each other and are approximately 1/16~1/8 inches so as to avoid hindering eyeshot. They form raised portions extending from the C-shaped body member 1. The golf putting practice device of the present invention is made of a light material such as plastic, metal and the like. Since the C-shaped body member 1 is provided not only with the above mentioned matters but the open space 6 which opens downward, even though the golf putting practice guiding device of the present invention attaches to the striking face and top of the putter head 9, the user or trainee can feel the ball being struck by the face of the original golf putter head 9.

Figure 2:
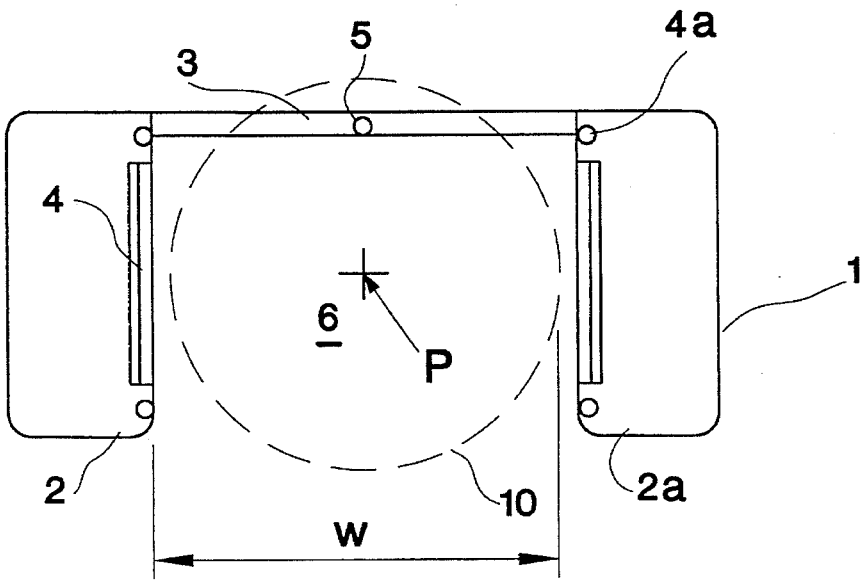
FIG. 2 is a front view of the golf putting practice guiding device in accordance with the present invention showing the sweet spot of the putter head of the golf putter.
Figure 3:
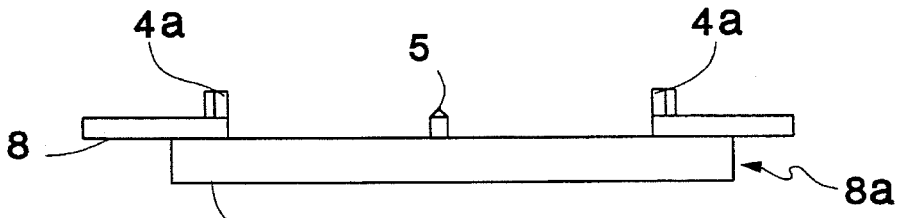
FIG. 3 is a top plan view of the golf putting practice guiding device in accordance with the present invention showing a bridge extending backward at a right angle from both legs.

As shown in FIGS. 1 and 2, a width W of the opening space 6 is of importance as it largely determines the degree of skill required to strike the golf ball 10 with the striking face without contacting the rails 4, pins 4*a*, and marker pin 5 and being deflected thereby. In general, the golf beginner needs a larger width than the professional golfer. Accordingly, the width W of the opening space 6 is about 1.1~1.5 inches.

Figure 4:
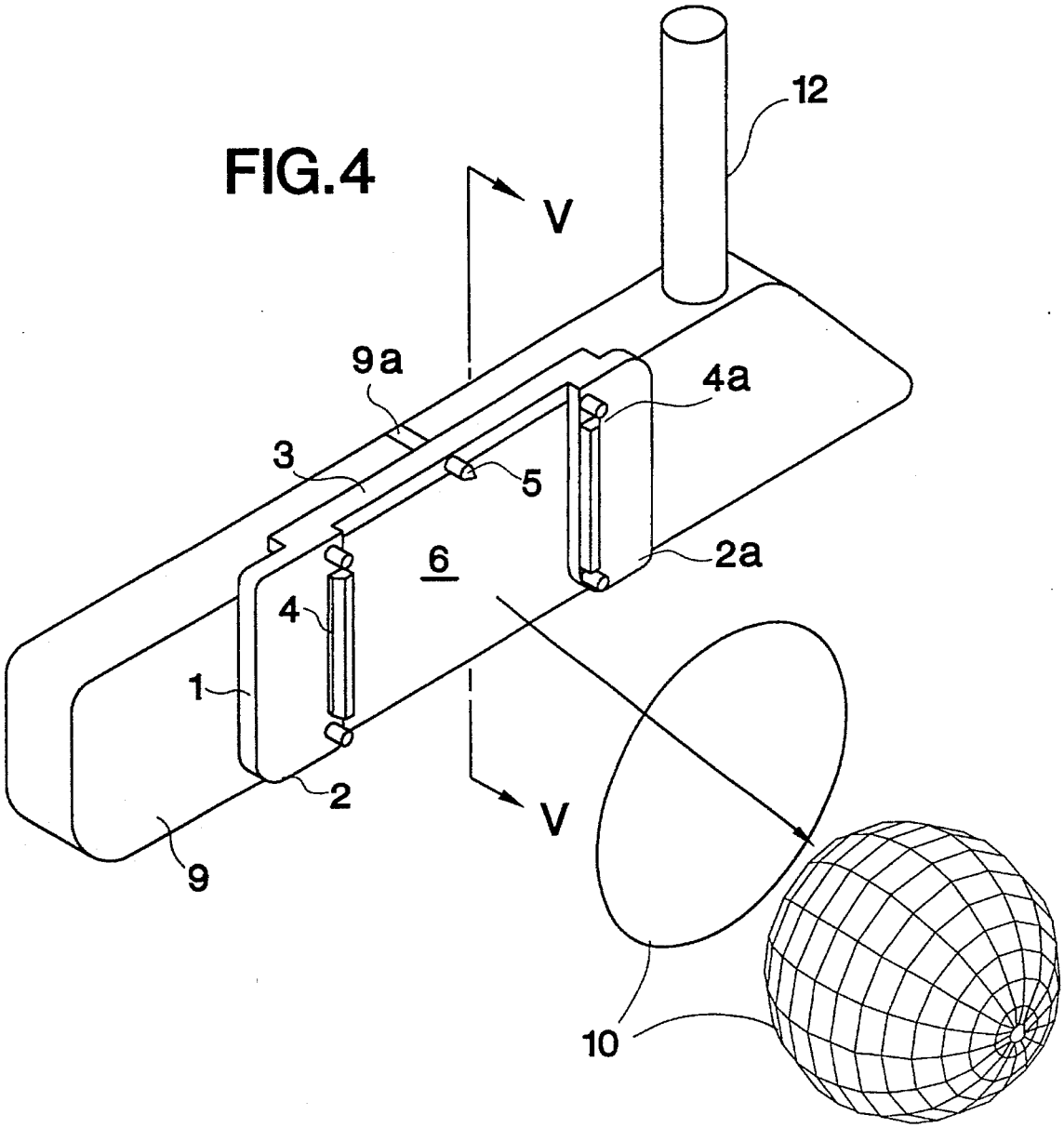
FIG. 4 is a perspective view of the golf putting guiding device in accordance with the present invention attached to the striking face and the top of a putter head.
Figure 5:
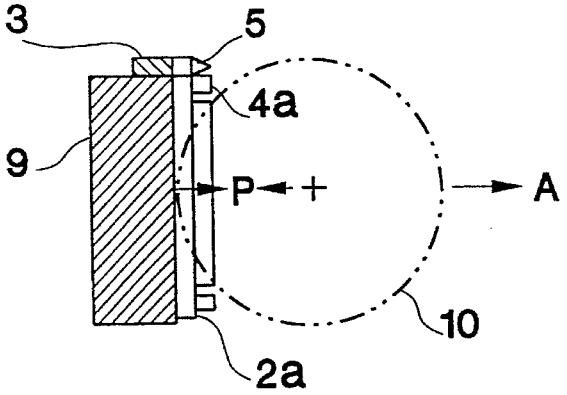
FIG. 5 is a sectional view of FIG. 4, taken along line V—V.
Figure 7:
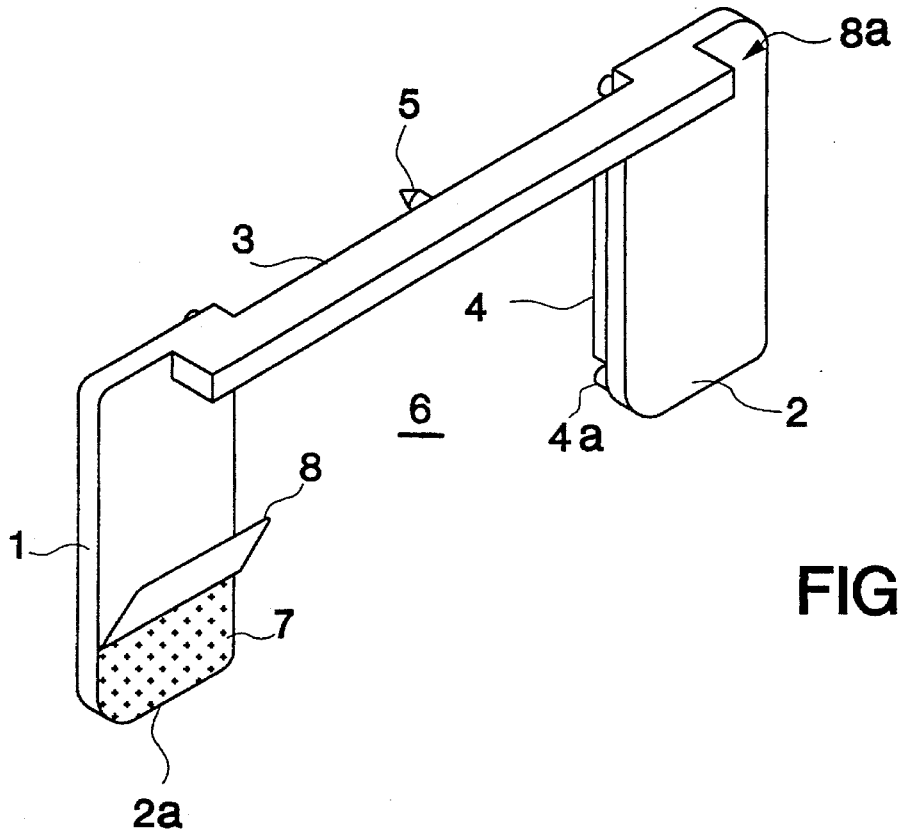
FIG. 7 is a perspective view of the golf putting practice guiding device in accordance with the present invention showing a rear surface thereof.

Referring now to FIGS. 4 and 7, the rear face of the C-shaped body member 1 contains a layer of a non-dry pressure sensitive adhesive 7 which in turn is covered with a sheet 8 of waxed paper to protect the adhesive layer 7 thereof until the golf putting practice guiding device of the present invention is ready to be attached to the striking face 9*b* of the golf putter 12.

FIGS. 4, 5, 6(A) and 6(B) illustrate the operation of the golf putting practice device of the present invention as follows. First of all, the golf putting practice device of the present invention is attached to the striking face of the putter head 9 of the conventional golf putter 12 (FIG. 4). Preferably, the golf putting practice device is removably attached to the striking face with the adhesive 7 on the rear face of the C-shaped body member 1 after the waxed paper sheet 8 is separated from the rear face of the C-shaped body member 1.

At this time, the golf putting practice device of the present invention is carefully positioned on the striking face so that the marker pin 5 disposed thereon, which is at the geometric center of the bridge 3, is lined up with the marker 9*a* and over the sweet spot P or the center of gravity of the putter head 9 of the putter 12. It is essential that the device of the present invention be so positioned, as otherwise it is not as effective for the intended purpose.

As shown in FIGS. 4, 5, 6(A), and 6(B), the conventional golf putter 12 may be used as a practice putter. When the golf ball 10 is hit solidly so as to avoid the pair of rails 4, the two pairs of pins 4*a* and the marker pin 5, it moves straight forward in the direction indicated by arrow A as shown in FIG. 6(A), toward the desired target such as a hole in the golf green.

On the contrary, when the golf ball 10 is not hit properly, the rails 4, pins 4*a*, or marker pin 5 strike the ball and it is deflected in the direction indicated by arrows B and C as shown in FIGS. 6(A) and 6(B). Inasmuch as the golf putter 11 with the golf putting practice guiding device attached thereto has the same putting characteristics during practice as when playing a round of golf with the golf putting practice guiding device removed, it is apparent that a golfer may rapidly improve his putting proficiency.

Figure 8:
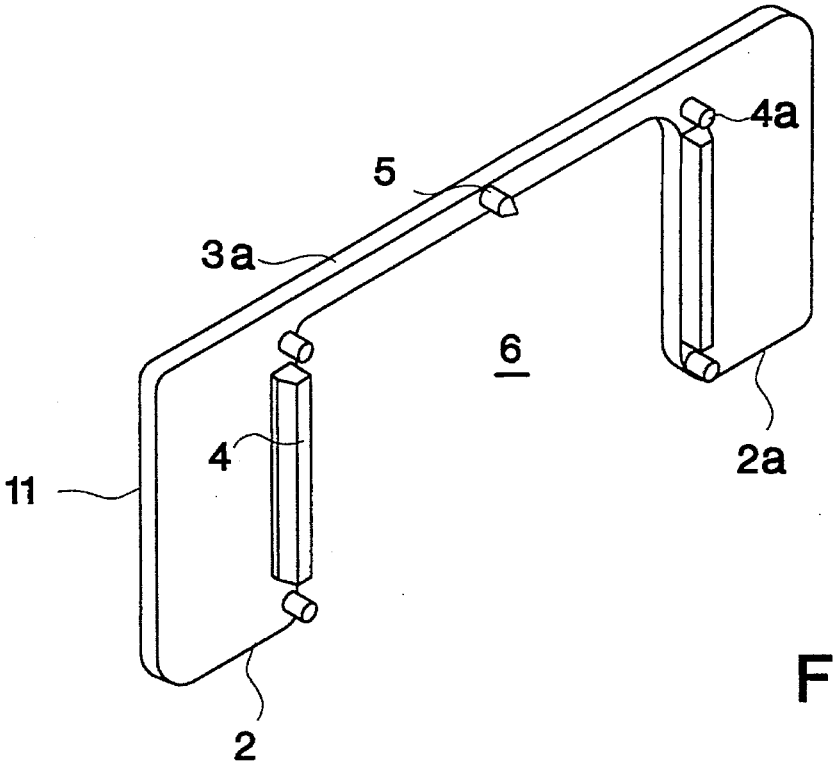
FIG. 8 is a perspective view of a second embodiment of the golf putting practice guiding device in accordance with the present invention showing a pair of legs and a bridge in a composite plate.

Referring in detail to FIG. 8, there is illustrated an additional embodiment of a golf putting practice guiding device in accordance with the present invention. The golf putting practice guiding device comprises the C-shaped body member 11 including the vertically elongated left and right legs 2 and 2*a*, and a horizontally elongated bridge 3*a* connected to both left and right legs 2 and 2*a* and formed as a composite plate for readily and effectively attaching to the striking face of the putter head 9 of the golf putter 12 even though the golf putter 12 may have a slant putter neck thereof.

As shown in FIG. 8, the C-shaped body member 11 further includes a pair of rails 4, two pairs of pins 4*a*, the marker pin 5, the non-dry pressure sensitive adhesive layer 7, the waxed paper 8, and the open space 6, which is the same as shown in FIGS. 1 and 7.

Accordingly, as shown in FIGS. 6(A) and 6(B), the golf putting practice guiding device according to the present invention permits one to develop a natural putting stroke in a simple and efficient manner without actually fettering or restraining the golf putter 12. If the practicing golfer's swing deviates excessively from the natural swing, the pair of rails, two pairs of pins, and marker pin 5 of the golf putting practice guiding device of the present invention will be touched by the golf ball 10, thus indicating a necessity for correcting the swing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf putting practice device for use on a putter head of a golf putter, comprising:

a C-shaped body member defining a front surface and a rear surface, said C-shaped body member including:

a vertically elongated left leg, a vertically elongated right leg, a bridge portion for connecting said vertically elongated left and right legs, a pair of vertically elongated rails extending from said front surface along the inside edges of said left and right legs, two pairs of pins extending from said front surface near the ends of said rails, and a marker pin extending from said front surface at the center of said bridge portion, said rails, pins, and marker pin each having a same height, and an open space having a downward opening located at an inside of said C-shaped body member.

2. The golf putting practice device of claim 1, wherein said bridge portion extends backward at a right angle from both left and right legs so that it can be attached to a top and front surface of a putter face.

3. The golf putting practice device of claim 2, wherein a pair of spaces are disposed at the ends of said bridge portion so that the device can be attached to a golf putter having a slanted putter shaft.

4. The golf putting practice device of claim 1, wherein said bridge portion and said left and right legs are formed as a composite plate with the rear surface of said C-shaped member being flat.

5. The golf putting practice device of claim 1, wherein said vertically elongated rails, said pins and said marker pin have a same height of about 1/16 ~1/8 inches.

6. The golf putting practice device of claim 1, wherein said opening space has a width of 1.1~1.5 inches.

7. The golf putting practice device of claim 1, wherein said C-shaped body member is made of durable plastic.

8. The golf putting practice device of claim 1, wherein said C-shaped body member is made of metal.

9. The golf putting practice device of claim 1, further comprising a layer of pressure sensitive adhesive disposed on said rear surface of the C-shaped body member.

10. The golf putting practice device of claim 1, wherein the rails, the two pairs of pins, the marker pin, and the open space of the C-shaped body member is dimensioned to allow a golf ball to pass therebetween and strike a sweet spot of said golf putter through said open space when the golf putter is properly stroked.

11. A golf putting practice device for use on a putter head of a golf putter, comprising:

a C-shaped body member having a front surface and a rear surface, said C-shaped body member including:

a vertically elongated left leg, a vertically elongated right leg, a bridge portion for connecting said vertically elongated left and right legs, said bridge portion extending backward at a right angle from both left and right legs for tightly attaching to a top and front surface of a putter face and a pair of spaces provided at the ends of said bridge portion so that the device can be attached to a golf putter having a slanted putter shaft, and an open space located at an inside of said C-shaped body member, wherein upon attaching the golf putting practice device to a face of a golf putter, the elongated left and right legs allow a golf ball to pass therebetween and strike a sweet spot of the face of said golf putter through the opening space of the C-shaped body member when the golf putter is properly stroked.

12. The golf putting practice device of claim 11, wherein said bridge portion and said left and right legs are formed as a composite plate with the rear surface of said C-shaped member being flat.

13. The golf putting practice device of claim 11, wherein said opening space has a width of 1.1~1.5 inches.

14. The golf putting practice device of claim 11, wherein said C-shaped body member is made of durable plastic.

15. The golf putting practice device of claim 11, wherein said C-shaped body member is made of metal.

16. The golf putting practice device of claim 11, further comprising a layer of adhesive disposed on said rear surface of the C-shaped body member.

17. The golf putter of claim 16 wherein the layer of adhesive is covered with a sheet of wax paper.

18. The golf putting practice device of claim 11, further comprising a pair of vertically elongated rails extending from the front surface along the inside edges of said left and right legs, two pairs of pins extending from the front surface near the ends of said rails and a marker pin extending from the front surface at a center of said bridge portion.

19. The golf putting practice device of claim 11 wherein said vertically elongated rails, said two pairs of pins and said marker pin have a same height of about 1/16~1/8 inches.

20. A golf putter having a putter head, a putter shaft connected to said putter head and a putting practice device attached to said putter head, said putting practice device comprising:

a C-shaped body member defining a front surface and a rear surface, said C-shaped body member including:

a vertically elongated left leg, a vertically elongated right leg, a bridge portion for connecting said vertically elongated left and right legs, a pair of vertically elongated rails extending from said front surface along the inside edges of said left and right legs, two pairs of pins extending from said front surface near the ends of said rails, and a marker pin extending from said front surface at the center of said bridge portion, said rails, pins, and marker pin each having a same height, and an open space having a downward opening located at an inside of said C-shaped body member.

21. The golf putter of claim 20, wherein said bridge portion extends backward at a right angle from both left and right legs so that it can be attached to a top and front surface of a putter face.

22. A golf putter having a putter head, a putter shaft connected to said putter head and a putting practice device attached to said putter head, said putting practice device comprising:

a C-shaped body member having a front surface and a rear surface, said C-shaped body member including:

a vertically elongated left leg, a vertically elongated right leg, a bridge portion for connecting said vertically elongated left and right legs, said bridge portion extending backward at a right angle from both left and right legs for tightly attaching to a top and front surface of a putter face and a pair of spaces provided at the ends of said bridge portion so that the device can be attached to a golf putter having a slanted putter shaft, and an open space located at an inside of said C-shaped body member, wherein upon attaching the golf putting practice device to a face of a golf putter, the elongated left and right legs allow a golf ball to pass therebetween and strike a sweet spot of the face of said golf putter through the opening space of the C-shaped body member when the golf putter is properly stroked.

23. The golf putter of claim 22, further comprising a pair of vertically elongated rails extending from the front surface along the inside edges of said left and right legs, two pairs of pins extending from the front surface near the ends of said rails and a marker pin extending from the front surface at a center of said bridge portion.

* * * * *

UNITED STATES PATENT AND TRADEMARK OFFICE

CERTIFICATE OF CORRECTION

PATENT NO. : 5,478,078

DATED : December 26, 1995

INVENTOR(S) : Lee, Do Won

It is certified that error appears in the above-indentified patent and that said Letters Patent is hereby corrected as shown below:

On title page, insert the foreign application priority information as follows:

--[30] Foreign Application Priority Data

Oct. 21, 1994 [KR] Korea.....94-27146--

Signed and Sealed this

Thirteenth Day of August, 1996

*Attest:*

*Attesting Officer*

BRUCE LEHMAN

*Commissioner of Patents and Trademarks*